US009052175B1

(12) United States Patent
Calvert

(10) Patent No.: US 9,052,175 B1
(45) Date of Patent: Jun. 9, 2015

(54) SABOTAGE CARTRIDGE WITH TOXIC AGENT

(71) Applicant: SCTA Associates, Trustee for Sabotage Cartridge with Toxic Agent CRT Trust, Manassas, VA (US)

(72) Inventor: S. Mill Calvert, Manassas, VA (US)

(73) Assignee: SCTA Associates, Trustee for Sabotage Cartridge with Toxic Agent CRT Trust, Manassas, VA (US)

( * ) Notice: Subject to any disclaimer, the term of this patent is extended or adjusted under 35 U.S.C. 154(b) by 0 days.

(21) Appl. No.: 14/513,996

(22) Filed: Oct. 14, 2014

(51) Int. Cl.
*F42B 12/46* (2006.01)
*F42B 12/36* (2006.01)

(52) U.S. Cl.
CPC ..... *F42B 12/46* (2013.01); *F42B 12/36* (2013.01)

(58) Field of Classification Search
None
See application file for complete search history.

(56) References Cited

U.S. PATENT DOCUMENTS

| | | | | | |
|---|---|---|---|---|---|
| 1,517,554 | A | * | 12/1924 | Fulcher | 102/370 |
| 1,702,133 | A | * | 2/1929 | Remondy | 102/275 |
| 3,361,066 | A | * | 1/1968 | Gawlick et al. | 102/513 |
| 3,431,853 | A | | 3/1969 | Warner et al. | |
| 4,708,869 | A | | 11/1987 | Koblin | |
| 4,798,143 | A | | 1/1989 | Graham | |
| 7,143,699 | B2 | | 12/2006 | Brock et al. | |

* cited by examiner

*Primary Examiner* — Stephen M Johnson
(74) *Attorney, Agent, or Firm* — Louis Ventre, Jr.

(57) ABSTRACT

A capsule is configured to have the outward appearance of a cartridge for a firearm and the capsule is designed to release a toxic agent when struck by the firing pin of the firearm. The capsule includes a casing; a bullet shaped container; a toxic agent, and a cup. The casing is made to fit within a firing chamber of the firearm. A bullet-shaped container holds the toxic agent under pressure. The container fits within the casing to give an outward appearance of an ordinary bullet in a regular cartridge for that firearm. The cup gives the outward appearance of a primer cup. Once hit by the firing pin of the firearm, the cup breaks, releasing the toxic agent. A primer and remote radio-frequency activator may also be used to release the toxic agent.

7 Claims, 3 Drawing Sheets

SABOTAGE CARTRIDGE WITH TOXIC AGENT

TECHNICAL FIELD

In the field of ammunition and explosives, a cartridge that vents toxic gas when fired from a weapon.

BACKGROUND ART

Military technology has become highly advanced to the point where we have space-age, aerial laser weapons, high flying drones with hell-fire missiles and sophisticated robotics. But the primary weapon of war that is used world-wide today is still the low-tech cartridge that is fired from a rifle, such as an AK-47.

One need only to turn on the television news on any day to see the various terror groups and enemy combatants that are using cartridges as their primary technology to kill with. This type of distributed enemy capability is very costly and difficult to overcome with high technology, such as drones, cruise missiles, and close air support gunships, because the enemy just scatters and blends in with the local population to hide.

The one thing an enemy combatant always has with him is his automatic rifle and a supply of cartridges. A country or a super power nation could spend hundreds of millions of dollars on various types of high-tech airstrikes without ever making a dent in this type of distributed, low-tech enemy force. To confront this enemy, it seems to always come back to a discussion of "boots on the ground" and how many persons are willing to be put at great risk.

The inevitable consequence is that the more soldiers committed as ground troops, translates to more body bags, missing limbs, and internet videos of severed heads.

SUMMARY OF INVENTION

A capsule is configured to have the outward appearance of a cartridge for a firearm. The capsule is designed to release a toxic agent when struck by the firing pin of the firearm and thereby incapacitate or kill the shooter and nearby enemy combatants. A primer and remote radio-frequency device may be used to release the toxic agent without impact of the firing pin. The capsule preferably includes a casing; a bullet shaped container; a toxic agent under pressure, and a look-alike primer cup that breaks when hit by the firing pin to release the toxic agent.

Accordingly, the casing is made to fit within a firing chamber of the firearm. A bullet-shaped container holds the toxic agent under pressure. This container fits within the casing, defining an inner container volume preferably extending from the inside wall of the firing end of the casing to a point beyond the end of the casing, to give an outward appearance of an ordinary bullet in a regular cartridge for that firearm. The bullet-shaped container when inserted into the casing closes off the open end of the casing just like in a regular cartridge.

Technical Problem

The majority of the enemy we face today, use AK-47's and ammunition to kill our soldiers and even shoot down our hi-tech helicopters. An important military strategy in the War on Terror would be to find an easy way to sabotage the enemy ammunition.

If only there was an inexpensive way to disable or kill this type of enemy without spending massive amounts of money and without putting "boots on the ground" to become horrific war and terror casualties.

Solution to Problem

The solution is a sabotage cartridge with toxic agent, which is a hollow metal, pressurized container in the shape of a bullet that is inserted into a standard brass casing. The pressurized container is loaded with one or more toxic agents. The pressurized container is inserted in the casing and is the part that sticks out the top of the casing to look like any other regular bullet. The bottom of the sabotage cartridge with toxic agent has a breakable cup that outwardly looks like a primer cup in a standard cartridge, but which breaks and releases the toxic agent when struck by the firing pin of the firearm.

If you hold a regular round in one hand and a sabotage cartridge with toxic agent in the other hand, they should be nearly identical in appearance and heft so that the user cannot tell them apart.

The sabotage cartridge with toxic agent is preferably manufactured with a marking system that the enemy will not recognize, so later, in peace time, the sabotage cartridge with toxic agent can be separated out so it will not cause an unwanted accident. Examples of such a marking system are an RFID chip, a magnetic marker, a chemical coating, or many other types of marking systems.

The inside of a sabotage cartridge with toxic agent is a hollow capsule that can contain one or more of various toxic agents. A toxic solution may be loaded into the capsule under pressure, or depending on the type of agent, they may have an additional gas added for pressurization. The toxic agent will then be forced to flow out into the air that is close to the enemy's face as he holds his rifle.

The sabotage cartridge with toxic agent preferably has a puncture-release cup that looks like a typical primer cup on any regular cartridge. For such embodiments, the cup on the sabotage cartridge with toxic agent is punctured or fractured when the firing pin strikes the cup. When so punctured or fractured, the sabotage cartridge with toxic agent releases the pressure and ejects the toxic agent into the air near the enemy's face so that he will breathe it in or get it on his skin.

When the enemy holds his gun to fire and looks down the barrel to aim, he will pull the trigger and immediately be contaminated with the toxic agent. His fellow terrorists will also have the sabotage cartridge with toxic agent rounds mixed in with their ammo, and even if they do not fire their gun and get the toxic agent on them, they will become contaminated and die from being around their contagious combatant. A small amount of toxic agent can be made to kill an entire group of the enemy in short order.

The sabotage cartridge with toxic agent may be made with an internal radio-frequency device to enable remote activation of the release of the toxic agent. This device enables activation to release the toxic agent without using the gun's firing pin to break the cup.

Advantageous Effects of Invention

The sabotage cartridge with toxic agent takes advantage of the fact that the cartridge is the primary tool of death that this type of enemy uses and always has with him. The sabotage cartridge with toxic agent technology now turns the enemy's cartridge ammunition into a weapon of their own death and possibly the death of all his nearby combatants.

The sabotage cartridge with toxic agent preferably looks identical to any other ammo cartridge used by the enemy. It preferably has the weight and feel of a regular firearm cartridge so that the terrorist cannot tell which cartridge is the sabotage cartridge with toxic agent or a normal round.

As the enemy army sees their friends being killed or incapacitated, they will become hesitant to fire their weapons knowing that the next fired round may kill or incapacitate them. This would be like trying to convince a soldier to try and fight a war by playing Russian roulette. Troop morale would drop as most fighters remove the cartridges from their weapons and retreat. Word would spread throughout the enemy army spreading uncertainty about their ammunition. This lack of dependable ammunition could bring a quick end to the war or conflict.

The primary component of war is an enemy's ammunition. Without dependable ammunition, the enemy has nothing to fight with. The sabotage cartridge with toxic agent will now add another very useful military tool that will help to shorten conflicts, save our soldiers' lives, and help to win the War on Terror.

The sabotage cartridge with toxic agent can quickly disable or kill him and his fellow terrorists as he tries to fire the sabotage cartridge with toxic agent. The sabotage cartridge with toxic agent can contaminate the shooter with various types of deadly and contagious toxic chemical agents, infectious diseases and viral agents. The terrorist can be made to be highly contagious and then transfer the disease to all of his fellow terrorists.

Used in this fashion, the sabotage cartridge with toxic agent technology could easily wipe out and kill all of the terrorists in a cell. A few hundred dollars of sabotage cartridge with toxic agent rounds covertly placed into the enemy ammo supply can do what several hundred million dollars of airstrikes could not do.

The sabotage cartridge with toxic agent should be covertly placed with the enemy. Such covertly placed sabotage cartridge with toxic agent may cost a few hundred dollars but can now do what billions of dollars in high-tech air strikes and "boots on the ground" cannot do: instill fear, kill and incapacitate a dispersed enemy force.

This new technology uses the cartridges that the enemy carries with him as a means to deliver a toxic agent that will wipe out and destroy the enemy no matter where they are hiding.

The sabotage cartridge with toxic agent technology can change the tide of war and kill or incapacitate the type of terrorist that threatens humanity on this Earth.

The effects are significant: No more billions of dollars wasted on air campaigns; no more brave patriotic soldiers coming home in body bags; no more destroyed lives with missing limbs; and no more severed heads being held up on the Internet. The sabotage cartridge with toxic agent technology can help to win the war on terror at low cost without risking our bravest and finest young men.

BRIEF DESCRIPTION OF DRAWINGS

The drawings illustrate preferred embodiments of the sabotage cartridge with toxic agent according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate a preferred embodiment of the sabotage cartridge with toxic agent according to the disclosure herein. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 2:
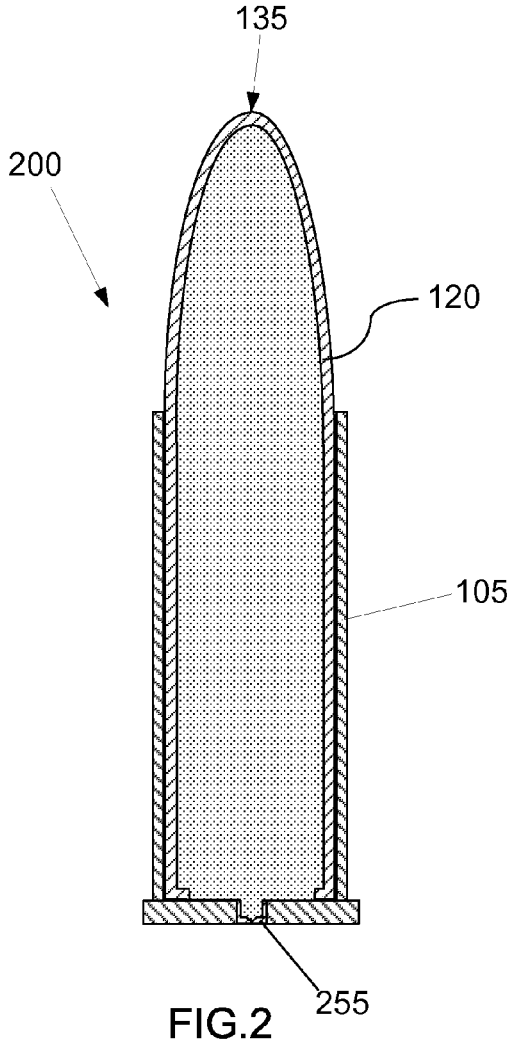
FIG. 2 is a sectional elevation view of the sabotage cartridge with toxic agent shown in FIG. 1.

A capsule (200), shown in FIG. 2, is configured to have the outward appearance of a cartridge (405) for a portable firearm (400). The capsule (200) may be configured to mimic the appearance of any particular cartridge. For example, the capsule (200) preferably looks like an ordinary cartridge usable in a pistol or in a rifle. A semi-automatic pistol is shown in FIG. 4, but this is simply an example for illustration purposes and not meant to circumscribe the scope of the portable firearm (400).

Examples of some common cartridges are .17 caliber HM2; .17 caliber HMR; .22 caliber LR 4; .22 caliber WMR; 0.17/23 caliber SMc; 5 mm/35 caliber SMc 7; .22 caliber HORNET; .223 caliber REMINGTON; .223 caliber WSSM; .243 caliber WINCHESTER; .243 caliber WINCHESTER Improved (Ackley); .25-06 caliber REMINGTON; .270 caliber WINCHESTER; .308 caliber WINCHESTER; .30-06 caliber SPRINGFIELD; .45-70 caliber Government; and .50-90 caliber SHARPS.

Figure 4:
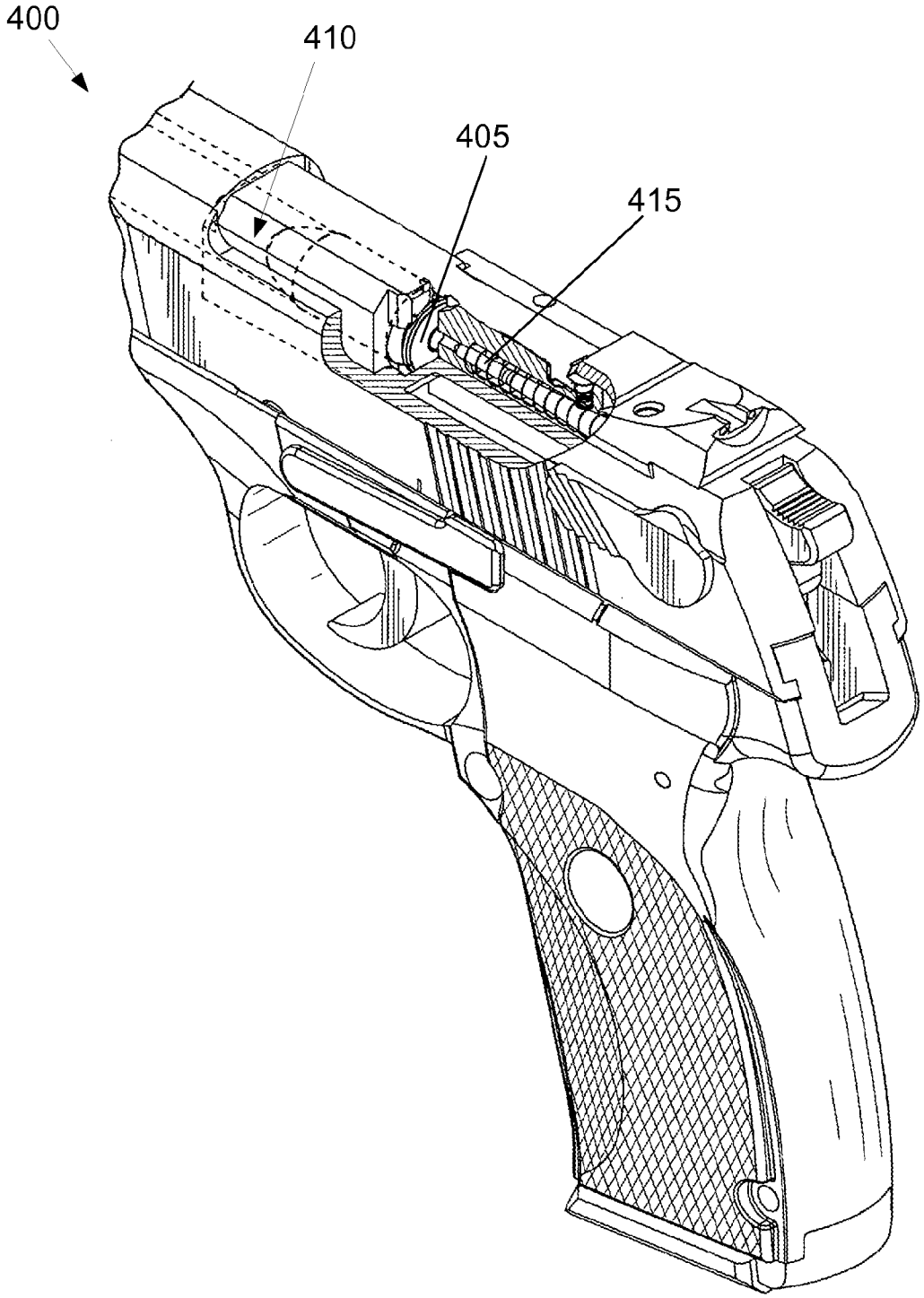
FIG. 4 is a partial perspective of a portable firearm with the capsule or look-alike cartridge loaded in the firing chamber.
Figure 5:
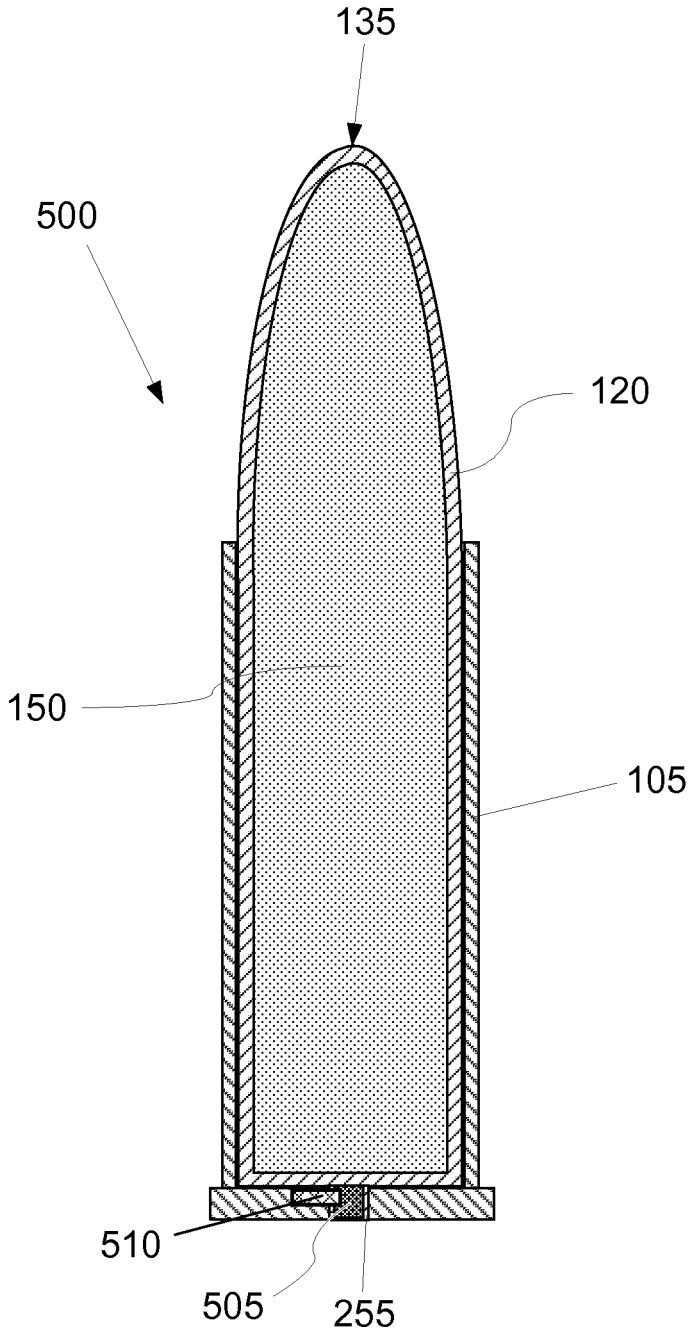
FIG. 5 is a sectional elevation view of an alternative embodiment of the sabotage cartridge with toxic agent where a primer is present in the cup.

A cartridge (405), shown in FIG. 4, is also commonly referred to as a round or a shell and may have varied shapes, sizes and outward appearances for a particular firearm and a particular shooting purpose. The capsule (200) would therefore preferably also take on the same shape, size, weight and outward appearance of the cartridge (405) it is intended to mimic. Thus, the capsule (200) would mirror the neck size, overall cartridge weight and caliber, headspace, overall length, case body diameter and taper, shoulder design, rim type, etc.

A cartridge (405) is a type of ammunition typically packaging together a bullet, a propellant substance, which is usually either smokeless powder or black powder, and a primer. The capsule (200) that is preferred is different in that it does not contain a bullet propellant because propelling the bullet from the chamber is not the function of the capsule (200). Rather, the function of the capsule (200) is to release a toxic agent (150) from the rear of the firing chamber (410) of the portable firearm (400), thereby killing or incapacitating the shooter and potentially any nearby enemy fighters.

In most regular ammunition, the cartridge primer is a small charge of an impact-sensitive or electric-sensitive chemical mixture that can be located at the center of the case head (centerfire ammunition), inside a rim (rimfire ammunition), or in a projection such as in a pinfire or teat-fire cartridge. The cup (255) of the capsule (200) is similar in appearance, but is different in the preferred embodiment in that it operates to break apart and release the toxic agent (150) instead of igniting a propellant substance in a regular cartridge.

The capsule (200) is adapted to, that is, the capsule is designed to, release the toxic agent (150) from the firing chamber (410) of a firearm and kill or incapacitate the shooter when the cup (255) is impacted by the firing pin of the portable firearm (400). The portable firearm (400) is any carryable gun having a barrel that launches one or more projectiles when a firing pin in the firearm impacts a regular cartridge loaded in the firing chamber (410).

Figure 1:
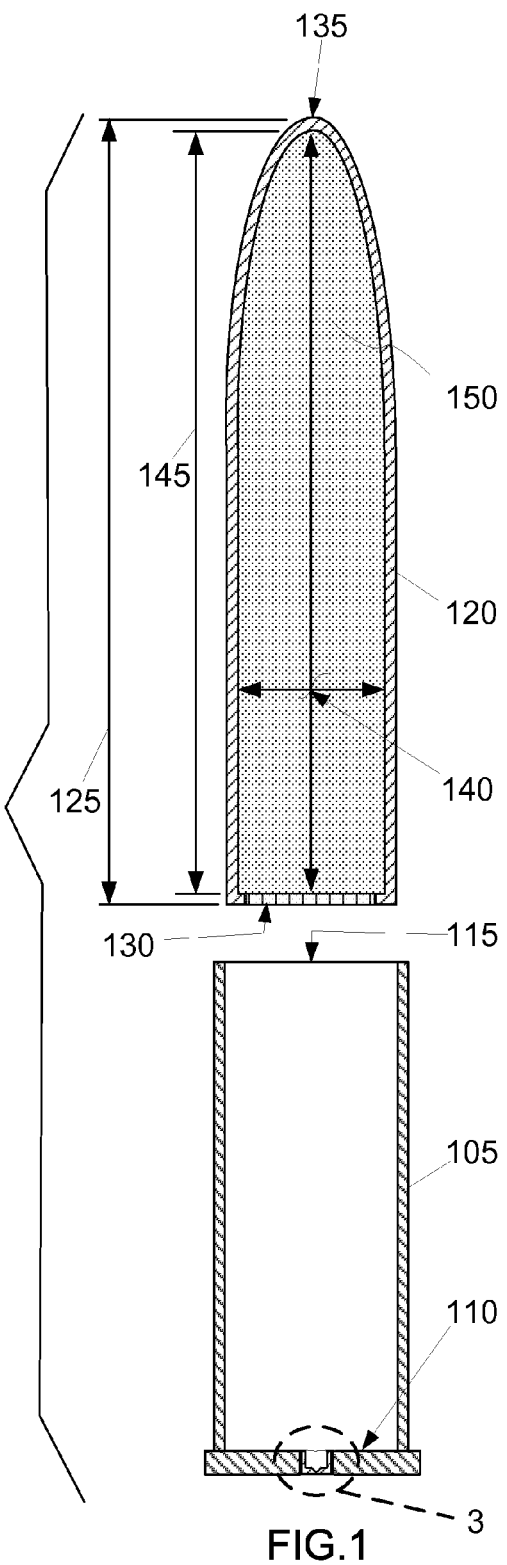
FIG. 1 is an exploded sectional elevation view of a preferred sabotage cartridge with toxic agent.

FIG. 1 is an exploded sectional elevation view showing the components of a preferred embodiment of the capsule (200). The capsule (200) includes a casing (105); a bullet-shaped container (120); a toxic agent (150) and a cup (255). FIG. 2 shows these components in assembled form.

The casing (105) is made to fit within the firing chamber (410) of a portable firearm (400). The casing (105) has a closed end (110) and an open end (115). The casing (105) is designed to mimic, that is be nearly identical in outward appearance to, an operable cartridge case.

The bullet-shaped container (120) has an outer length (125) defined by a proximal end (130) and a distal end (135).

The proximal end (130) is the end of the bullet-shaped container (120) located nearest the closed end (110) of the casing (105). The proximal end (130) is made to fit tightly within the casing (105) below the open end (115) of the casing (105). A preferable embodiment is one where the bullet-shaped container (120) has a length sufficient to enable placing the proximal end (130) adjacent to the closed end (110) of the casing so that the bullet-shaped container (120) occupies the space defined by the casing (105). So for this preferable embodiment, the proximal end (130) of the bullet-shaped container (120) is located adjacent to the closed end (110) of the casing (105), as shown in FIG. 2.

The distal end (135) is the end of the bullet-shaped container (120) that extends past the open end (115) of the casing (105). The part of the bullet-shaped container (120) that extends above the open end (115) of the casing (105) terminating at the distal end (135) is the part of the capsule (200) that looks like the bullet in a regular or functional cartridge that can be fired from a weapon.

The bullet-shaped container (120) defines an internal volume (140). Thus, the internal volume (140) has an internal length (145) from the proximal end (130) to a point before the distal end (135). While the internal volume of the bullet-shaped container (120) need only be sufficient to hold the toxic agent (150), that point is preferably located at a distance from the proximal end (130) that is past, that is above, the open end (115) of the casing (105) when the bullet-shaped container (120) is within the casing (105). Even more preferably, the point is near the distal end (135), so that the internal volume (140) occupies almost the entire outer dimensions of the bullet-shaped container (120), except for a thin wall needed to preserve the appearance of a bullet. Such a configuration, shown in FIG. 2, limits the chance that the toxic agent (150) under pressure would cause the bullet-shaped container (120) to be ejected and propelled from the casing (105).

The bullet-shaped container (120) when inserted into the casing (105) closes off the open end (115) of the casing (105). This configuration is needed so that the capsule (200) looks like the cartridge it mimics.

The toxic agent (150) is resident within the internal volume (140). Thus, the toxic agent (150) is loaded and under pressure in the bullet-shaped container (120). The toxic agent (150) is preferably a liquid or a gas, but a fine powder that can be ejected as an aerosol may also be used. A sufficient charge of a toxic agent (150) will be needed to kill, incapacitate or disable the shooter when the capsule (200) it is fired.

There are many well known chemicals that can be used as the toxic agent (150). For warfare, the most useful will have an immediate deadly effect or can instantly incapacitate a person. Some of these are classified in a standard maintained by the U.S.-based National Fire Protection Association and identified in "NFPA 704: Standard System for the Identification of the Hazards of Materials for Emergency Response." Exemplary incapacitating agents include Agent 15 (BZ); Dimethylheptylpyran (DMHP); EA-3167 Kolokol-1; and PAVA spray Sleeping gas. Exemplary toxic agents that cause immediate vomiting are sensory irritants are also termed sternators or nose irritants. They irritate the mucous membranes to produce congestion, coughing, sneezing, and eventually nausea and include: Adamsite; Diphenylchloroarsine; Diphenylcyanoarsine. Exemplary toxic agents that are known to cause death or major residual injury from very short exposure time include: hydrogen cyanide; phosphine; sarin; and hydrofluoric acid. Exemplary nerve agents that are highly volatile include: Tabun; Soman; and Cyclosarin.

The cup (255) is preferably just an open top container. The cup (255) gives the false external appearance of being a regular primer cup that is in contact with a functional explosive primer within a cartridge (405). However, this is only the outward appearance in order to give the capsule (200) the look of a real cartridge. The capsule (200) preferably has no explosive primer for the firing pin (415) to trigger an explosion of a propellant for discharge of a bullet from the portable firearm (400).

In an alternative embodiment capsule (500), a primer (505) is loaded into the cup (255) such that when the cup (255) is struck by the firing pin (415), it explodes the primer (505), which in turn breaks the cup (255) and the bullet-shaped container (120) to release the toxic agent (150).

An internal radio-frequency controlled spark generator (510) may also be connected to the primer (505) so that, at any time, the primer (505) can be remotely exploded to release the toxic agent (150). Thus, for this embodiment, the radio-frequency controlled spark generator (510) is connected to the primer (505) to enable remotely exploding the primer (505) and releasing the toxic agent (150). Such remote activation does not depend on the trigger being pulled or the gun's firing pin impacting the cartridge (405).

While the capsule (200) has the outward appearance of a cartridge (405), there is preferably no propellant in the capsule (200), only a toxic agent (150) under pressure so that it escapes after the firing pin (415) strikes the cup (255). The capsule (200) that is preferred will not cause the discharge of a bullet when the cup (255) is struck by the firing pin (415) of the portable firearm (400).

Figure 3:
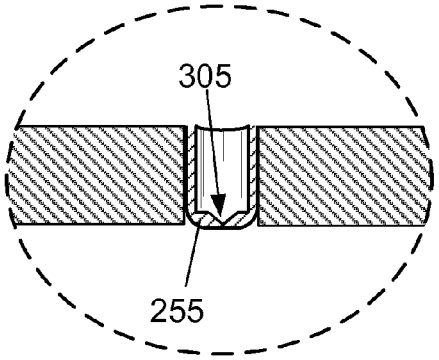
FIG. 3 is a portion of a view of FIG. 2 showing the cup with a notch enlarged for magnification purposes.

The cup (255) is preferably constructed with a notch (305), as shown in FIG. 3, which extends downward from the internal bottom of the cup toward the bottom outside wall of the cup (255). The notch (305) provides a high stress fracture line to facilitate breaking the cup (255) when it is struck by the firing pin (415).

Alternatively, the cup is made of a frangible material that will break upon being struck by the firing pin (415). Suitable frangible materials are well known and, in some cases, are used for bullets. Such materials can be made to look like all metal primer cups. The frangible material for the cup (255) may be made, for example, with powdered metal or materials formed with an injection molded process and contain different mixtures of copper, tin, and polymer.

In preferred embodiments, there is no intervening material or obstruction between the inside bottom of the cup (255) and the internal volume (140) of the bullet-shaped container (120). For these embodiments, the top of the cup (255) has unrestricted communication with the toxic agent (150) in the internal volume (140) of the bullet-shaped container (120).

The capsule (200) is preferably manufactured with a hidden marking that the enemy will not easily recognize. This marking will permit identification of the capsule (200) so that friendly forces can readily separate out the capsule (200) so as not to cause an unwanted accident. Examples of such a hidden marking include an RFID chip, a magnetic marker, an ultraviolet marking, an infrared marking, a specific chemical coating, or such other marking as may be functional for this purpose.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the firearms industry.

What is claimed is:

1. A capsule configured to have an outward appearance of a cartridge in combination with a portable firearm, the capsule releases a toxic agent when a firing pin strikes the capsule, the capsule comprising:

a casing made to fit within a firing chamber of a portable firearm, the casing having a closed end and an open end;

a bullet-shaped container having an outer length defined by a proximal end and a distal end, the proximal end fitted tightly within the casing below the open end of the casing;

the distal end extending past the open end of the casing;

the bullet-shaped container defining an internal volume, the internal volume having an internal length from the proximal end to a point before the distal end, said point being past the open end of the casing when the bullet-shaped container is within the casing; and the bullet-shaped container when inserted into the casing closes off the open end of the casing;

the toxic agent under pressure when resident within the internal volume; and a cup defining a notch, the notch positioned so that when the cup is struck by the firing pin of the portable firearm, the cup breaks and releases the toxic agent without causing discharge of the bullet-shaped container from the portable firearm when the cup is struck by the firing pin.

2. The capsule of claim 1, wherein the proximal end of the bullet-shaped container is located adjacent to the closed end of the casing.

3. A capsule configured to have an outward appearance of a cartridge in combination with a portable firearm, the capsule releases a toxic agent when a firing pin strikes the capsule without causing discharge of a bullet from the portable firearm, the capsule comprising:

a casing made to fit within a firing chamber of a portable firearm, the casing having a closed end and an open end;

a bullet-shaped container having an outer length defined by a proximal end and a distal end, the proximal end fitted tightly within the casing below the open end of the casing;

the distal end extending past the open end of the casing;

the bullet-shaped container defining an internal volume, the internal volume having an internal length from the proximal end to a point before the distal end, said point being past the open end of the casing when the bullet-shaped container is within the casing; and the bullet-shaped container when inserted into the casing closes off the open end of the casing;

the toxic agent under pressure when resident within the internal volume; and a cup.

4. The capsule of claim 3, further comprising a primer loaded within the cup such that when the cup is struck by the firing pin of the portable firearm, the primer explodes and thereby breaks the cup and the bullet-shaped container to release the toxic agent.

5. The capsule of claim 4, further comprising a radio-frequency controlled spark generator connected to the primer to enable remotely exploding the primer and releasing the toxic agent.

6. The capsule of claim 3 wherein the cup is made of a frangible material such that when the cup is struck by the firing pin of the portable firearm, the cup breaks and releases the toxic agent.

7. The capsule of claim 3, wherein the proximal end of the bullet-shaped container is located adjacent to the closed end of the casing.

* * * * *